United States Patent [19]

Jantzen

[11] Patent Number: 5,009,319

[45] Date of Patent: Apr. 23, 1991

[54] SHAPE GIVING SYSTEM FOR SOFT PURSES

[76] Inventor: Ellen E. Jantzen, 1226F Woodchase La., St. Louis, Mo. 63017

[21] Appl. No.: 104,822

[22] Filed: Oct. 2, 1987

[51] Int. Cl.[5] ..... A45C 1/00; A45C 3/08; A45C 11/20; A45C 13/02

[52] U.S. Cl. ..... 206/544; 150/104; 150/105; 150/107; 150/106; 150/113; 150/118; 150/129; 190/107; 190/125; 190/127; 383/97; 383/111

[58] Field of Search ..... 150/100, 103–105, 150/110, 113, 118, 129, 130, 106; 383/111, 37, 97, 119; 190/103, 107, 125, 127; 224/32 R; 206/543, 544

[56] References Cited

U.S. PATENT DOCUMENTS

| | | | |
|---|---|---|---|
| D. 224,072 | 6/1972 | Rosenblum | 150/113 X |
| 1,747,801 | 2/1930 | Topal | 150/104 |
| 1,978,970 | 10/1934 | Thornhill et al. | 150/130 |
| 2,080,453 | 5/1937 | Kraut | 150/104 |
| 2,175,327 | 10/1939 | Thornhill et al. | 150/105 X |
| 2,311,847 | 2/1943 | Long | 150/129 |
| 2,435,870 | 2/1948 | Campos | 150/104 |
| 2,609,854 | 9/1952 | Rosen | 383/111 X |
| 2,621,696 | 12/1952 | Barnes | 150/130 X |
| 2,653,640 | 9/1953 | Browning | 150/105 |
| 2,675,042 | 4/1954 | Herrera | 150/129 X |
| 2,694,427 | 11/1954 | Hovis | 150/105 |
| 2,779,373 | 1/1957 | Koepke | 150/105 |
| 2,784,756 | 3/1957 | Resnick | 150/103 |
| 2,798,524 | 7/1957 | Ryon | 150/103 |
| 2,845,974 | 8/1958 | Arden | 150/105 |
| 3,227,338 | 1/1966 | Hall | 150/100 X |
| 3,234,985 | 2/1966 | Gilbert | 150/105 |
| 3,347,299 | 10/1967 | Alexander | 150/113 |
| 3,414,033 | 12/1968 | Tucker | 150/104 |
| 3,473,713 | 10/1969 | Campbell | 190/107 X |
| 3,556,187 | 1/1971 | Speakes | 150/104 X |
| 3,692,078 | 9/1972 | Reitzel | 150/125 |
| 3,903,944 | 9/1975 | Montgomery et al. | 383/97 X |
| 3,958,616 | 5/1976 | Beverstock | 150/113 X |
| 4,059,207 | 11/1977 | Jackson et al. | 224/32 R X |
| 4,263,951 | 4/1981 | Siegel | 150/113 X |

FOREIGN PATENT DOCUMENTS

| | | | |
|---|---|---|---|
| 1104129 | 4/1961 | Fed. Rep. of Germany | 150/130 |
| 924297 | 7/1947 | France | 150/118 |
| 223823 | 10/1924 | United Kingdom | 150/105 |

*Primary Examiner*—Sue A. Weaver

*Attorney, Agent, or Firm*—Polster, Polster and Lucchesi

[57] ABSTRACT

A purse including a series of flexible plastic inserts that gives the purse shape when the plastic inserts are bent and placed into the soft "skin" of the purse. These plastic inserts can be removed, if desired, so that the "soft" purse can return to a foldable, storable, cleanable state. Purse straps may be detached and interchanged. Purse flaps may be detached and interchanged. A fitted, removable, liner/organizer lets the user change purses without removing the contents piecemeal.

21 Claims, 8 Drawing Sheets

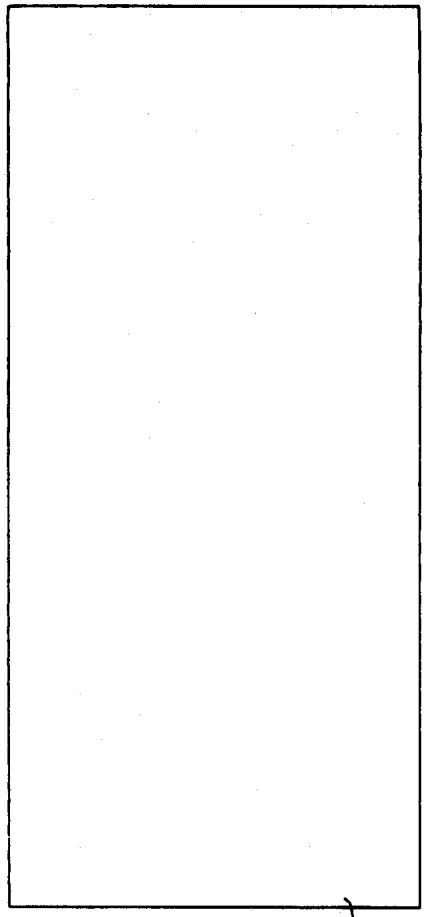
FIG.6
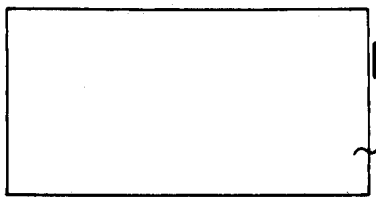
FIG.6C
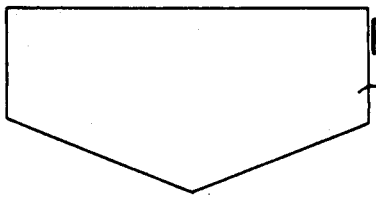
FIG.6B
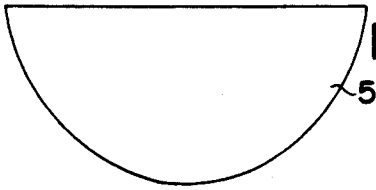
FIG.6A
FIG.6D
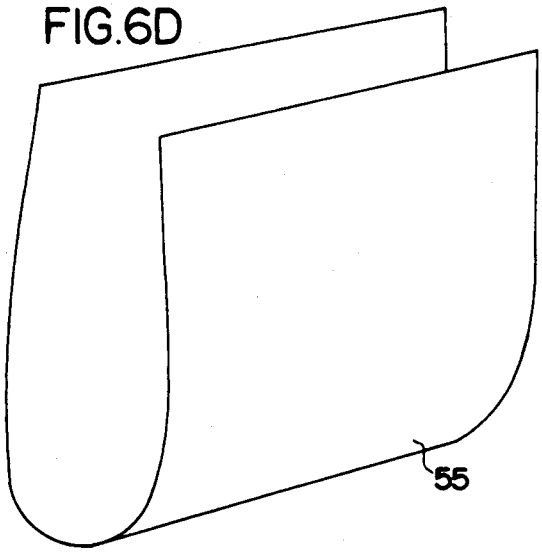
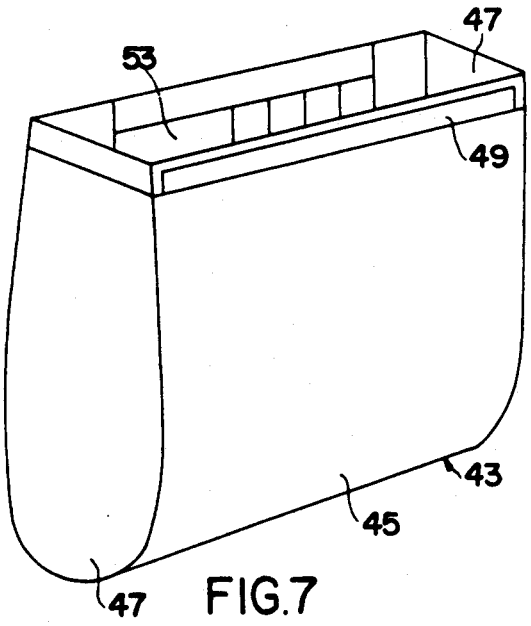
FIG.7
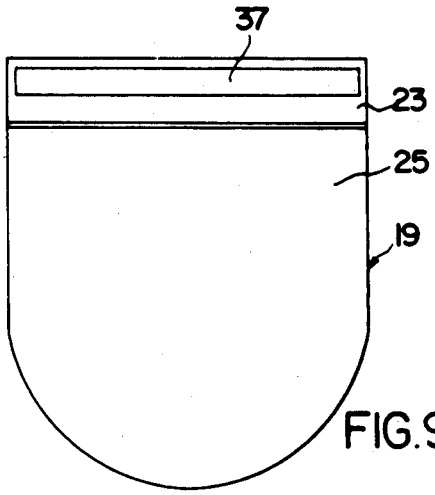
FIG.9

SHAPE GIVING SYSTEM FOR SOFT PURSES

BACKGROUND OF THE INVENTION

This invention relates to handbags or purses. The term "handbag" is used herein in the broad sense of a container of a size to be carried easily in the hand, on the shoulder, or on the back of a user.

Handbags are frequently made from heavy-weight fabrics, such as heavy cloth, leathers, vinyls, and the like. To retain their shape, they are provided with frames or are layered with stiffeners. Non-shaped purses are made with heavy non-stabilized fabrics that tend to misshape when personal items are placed inside. Because both shaped and non-shaped purses require fabrics which are heavier and stronger than normal garment fabrics in order to avoid stretching or tearing under the strain of frames and items in the purse, purses and clothing that match or coordinate are not normally marketed.

Attempts have been made to permit parts of shaped purses to be interchanged in order to allow some measure of fashion coordination. In some, such as Speakes, U.S. Pat. No. 3,556,187, decorative panels are inserted under a clear plastic cover. In others, such as Gilbert, U.S. Pat. No. 3,234,985, Houis, U.S. Pat. No. 2,694,427, Campos, U.S. Pat. No. 2,435,870, or Reitzel, U.S. Pat. No. 3,692,078, a fabric cover is releasably held to a rigid frame or body. These approaches lack flexibility, have not been aesthetically satisfactory, and have been difficult to use and change.

Currently available handbags also do not give the wearer the ability of "fine tuning" his or her ensemble. The feminine pronoun is used hereafter for simplicity, but it will be understood that the invention may also be used by men.

Conventional shaped handbags cannot be stored flat or packed flat for travel and cannot be easily cleaned.

SUMMARY OF THE INVENTION

One of the objects of this invention is to allow the fabrication of shaped handbags from garment-weight fabrics such as light-weight or mid-weight, non-structured cloths, leathers and vinyls of the sort conventionally used for making garments such as blouses, shirts, skirts, trousers, and dresses.

Another object is to provide the manufacturer the ability to produce purses that complement a given apparel line.

Another object is to provide a low cost and simple means to construct purses using standard apparel sewing techniques and equipment.

Another object is to provide a purse which may be stored and shipped flat both by the manufacturer and by the user.

Another object is to provide a system that allows manufacturers the ability to change styles, as fashion dictates, with minimal retooling costs.

Another object is to provide the home sewer the ability to make her own purses to coordinate with her clothing.

Another object is to provide the user the ability to easily change the entire body of the purse or parts of the purse to coordinate with her clothing.

Another object is to provide a purse which can be easily cleaned.

Another object is to provide a purse which permits the quick and easy change of straps and flaps in a variety of lengths, shapes, colors, and designs for fashion and useage considerations.

Another object is to provide a purse which allows the user to change purses without removing its contents piecemeal.

Another object is to provide a handbag system which is easily adaptable to hand-held bags, shoulder bags, briefcases, knapsacks, and other specialized handbags such as lunch boxes.

Other objects of this invention will be apparent to those skilled in the art in light of the following description and accompanying drawings.

In accordance with one aspect of this invention, generally stated, a flexible, resilient plastic sheet, of the appropriate size and thickness, is bent and inserted into a sewn handbag giving the handbag's body shape and rigidity. The plastic is chosen to bend readily to a U-shape, but to retain its resiliency, so that it continuously urges the mouth of the handbag open and springs toward a flat configuration when removed. Pockets at two parallel opposed mouth edges of the handbag hold the ends of the sheet. The pockets and the plastic sheet are proportioned to pull the skin of the handbag taut in two dimensions across the outer surface of the sheet.

In several preferred embodiments, a pair of unstiffened sides of the handbag hold the handbag from opening beyond a desired shape and provide a generally rectangular mouth at the top of the purse's body.

The unstiffened sides of the handbag body, in a preferred embodiment, are long enough to become the handbag's carrying straps. This strap portion may be tied, buttoned, snapped, or attached in some other way at the top to form the needed loop to allow for carrying the handbag.

In accordance with another aspect of the invention, a flap allows for the closure of the handbag's mouth to protect the contents of the purse and for decorative needs. This flap is detachable and therefore becomes interchangeable so that one handbag body may have a variety of flaps for fashion considerations.

In the preferred embodiment, an additional flexible plastic sheet, of appropriate size and thickness, is slipped into the free end of the flap of the sewn handbag, giving rigidity to a section of the flap which overlies a front face of the purse body.

The body of the preferred handbag contains a liner-/organizer of the same shape as the handbag's body, but proportionally smaller to allow for its insertion into the handbag body. This liner is attached in such a way as to be removable and transferable to another handbag of the same body style and size.

In another embodiment of the invention, the unstiffened sides of the handbag body are terminated at the top of the handbag body. With the addition of loops, straps can be fashioned that are detachable and interchangeable. These straps may contain hardware for adjusting the strap length, or straps of fixed varying lengths can be manufactured. The addition of detachable interchangeable straps allows fashion flexibility, so that both the material of the strap and the strap length may be chosen appropriately.

In another embodiment of the invention, the unstiffened sides of the handbag body are made wider at the top, then drawn-in with draw strings to give the handbag's body the ability to expand if needed.

In another embodiment of the invention, the unstiffened sides of the handbag body are terminated at the top of the handbag body to provide a clutch style purse, without straps.

In another embodiment of the invention, the unstiffened sides of the handbag body are continuous across the top of the handbag body and contain zippers for access to the handbag body. In this embodiment, the top of the body is arcuate, and the zippers permit the body to open flat. In this and other embodiments of the invention, the flaps are eliminated for closure purposes and the handbag closed by means of a zipper or other strip type fastener. Flaps can remain for decorative purposes over outside pockets.

In another embodiment of the invention, the zipper closure handbag is fashioned into a lunch box. The liner in this embodiment fills only the top half of the interior and is made of a moisture-proof, flexible material for the carrying of food. The lower half of the interior houses a vacuum bottle for liquid foods.

In another embodiment of the invention, the zipper closure handbag is sized and dimensioned to become a brief case. The liner/organizer, in this embodiment, attaches to either or both long sides of the brief case.

Other aspects of the invention will be better understood in light of the following description of the preferred embodiments of the invention.

BRIEF DESCRIPTION OF THE DRAWINGS

In the drawings.

FIG. 6 is a view in front elevation of a plastic insert that goes into the handbag body of FIGS. 1–5 to give it shape and rigidity.

FIGS. 6A–6C are views in front elevation of plastic inserts that go into the flaps of FIGS. 5A–5C, respectively.

FIG. 6D is a view in perspective of the insert of FIG. 6, showing it bent for insertion into the handbag body of FIGS. 1–5.

FIG. 7 is a view in perspective of a liner/organizer that attaches to the interior of the handbag's body.

FIG. 9 is a view of a flap showing the underneath side.

DESCRIPTION OF THE PREFERRED EMBODIMENTS

Figure 1:
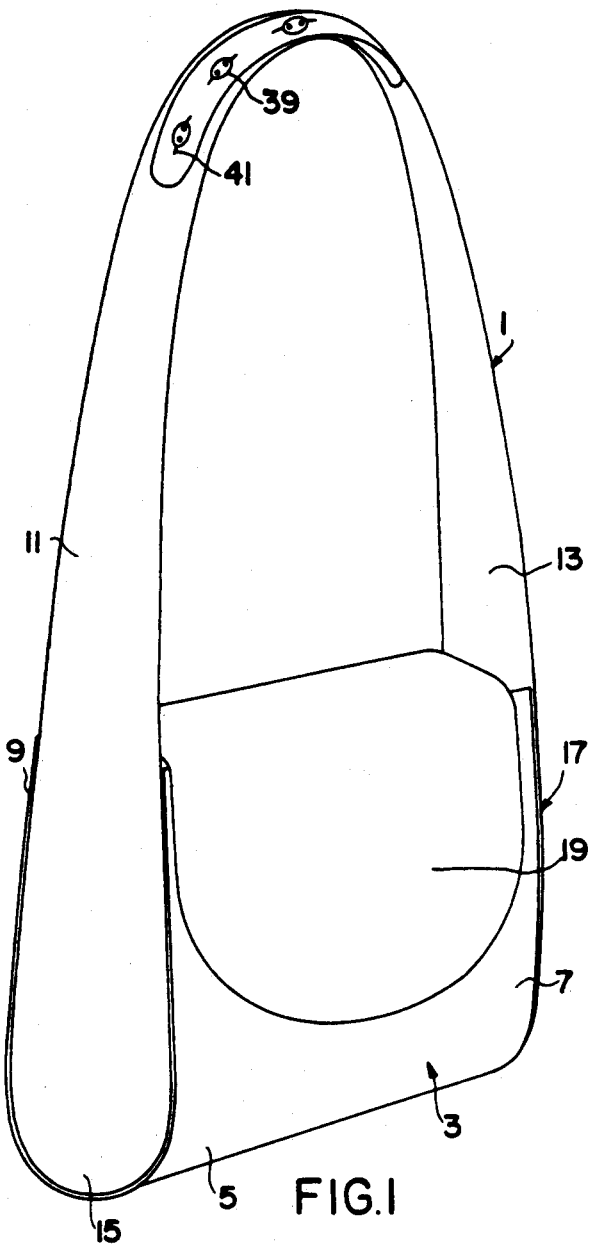
FIG. 1 is a view in perspective, from the front side, of one illustrative embodiment of handbag of the present invention, a round flap and buttoned strap being shown for illustration.
Figure 2:
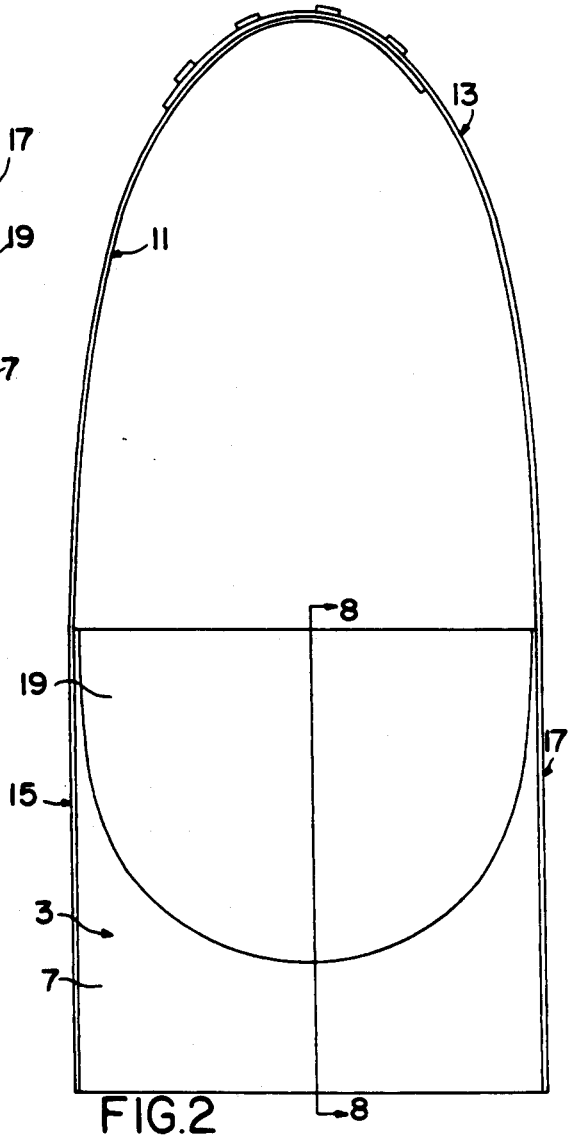
FIG. 2 is a front elevation of the handbag of FIG. 1.
Figure 3:
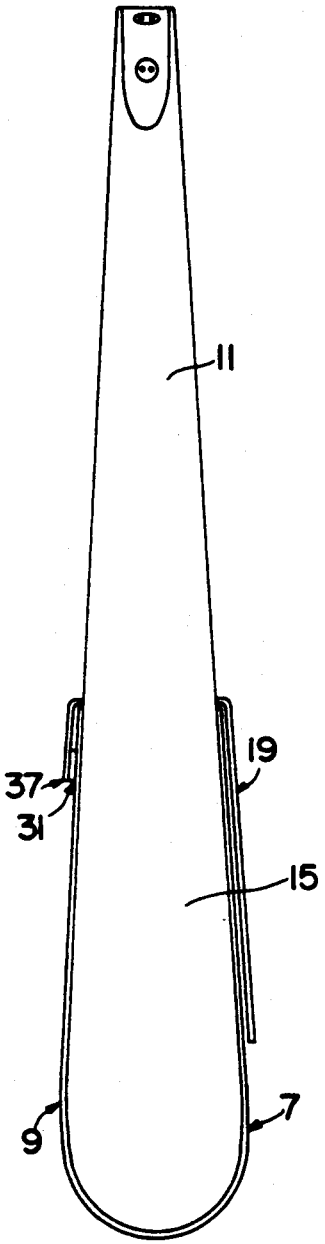
FIG. 3 is a view of one side elevation of the handbag of FIG. 1.
Figure 4:
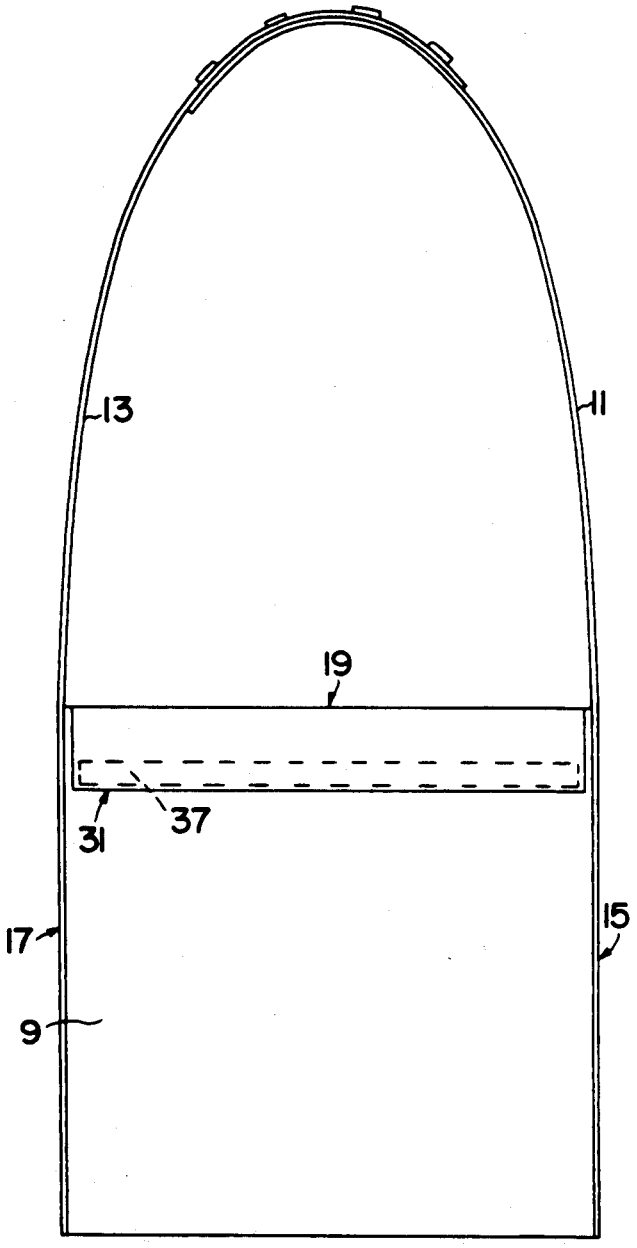
FIG. 4 is a back elevation of the handbag of FIG. 1.
Figure 5:
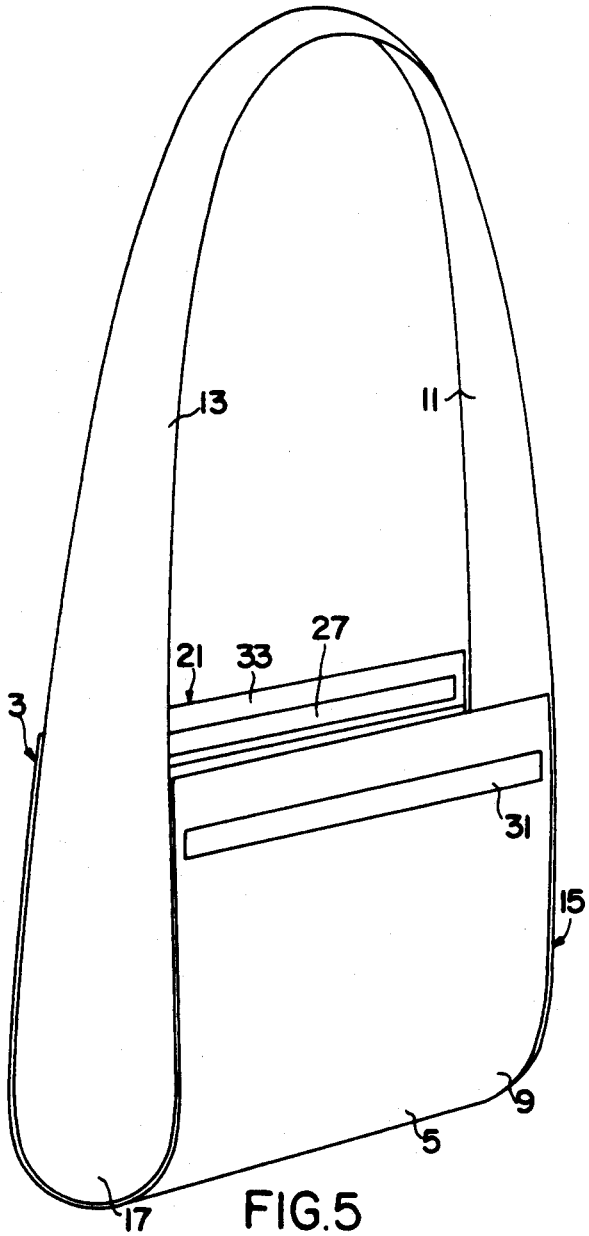
FIG. 5 is a view in back perspective of the handbag of FIG. 1 with the flap removed to show the inside of the handbag before a liner/organizer is installed.
Figure 5C:
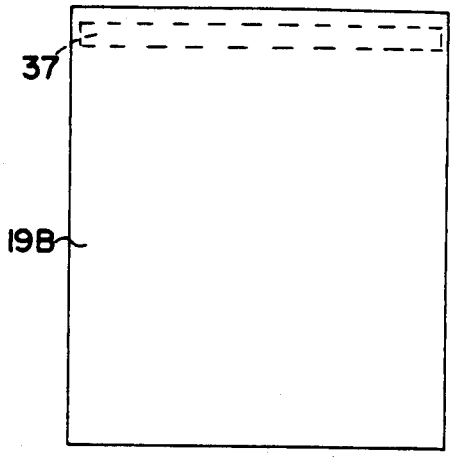
FIGS. 5A–5C are views in front elevation of detached flaps for use with the handbag of FIG. 1.
Figure 5B:
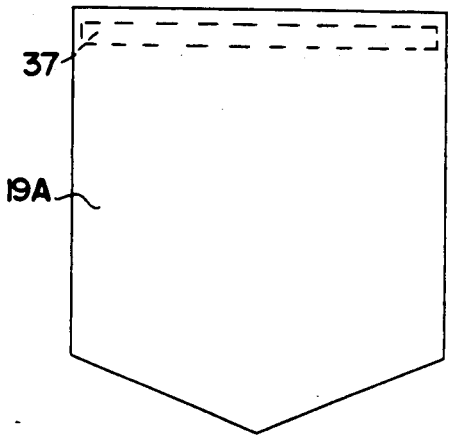
Figure 5A:
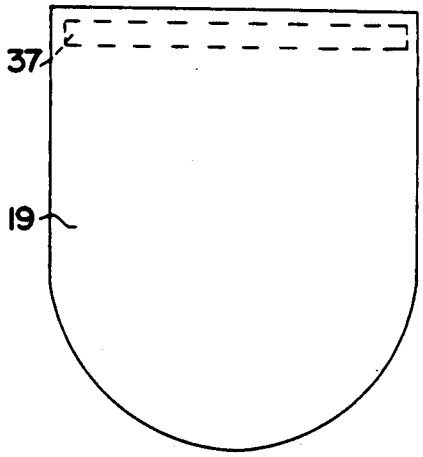
Figure 8:
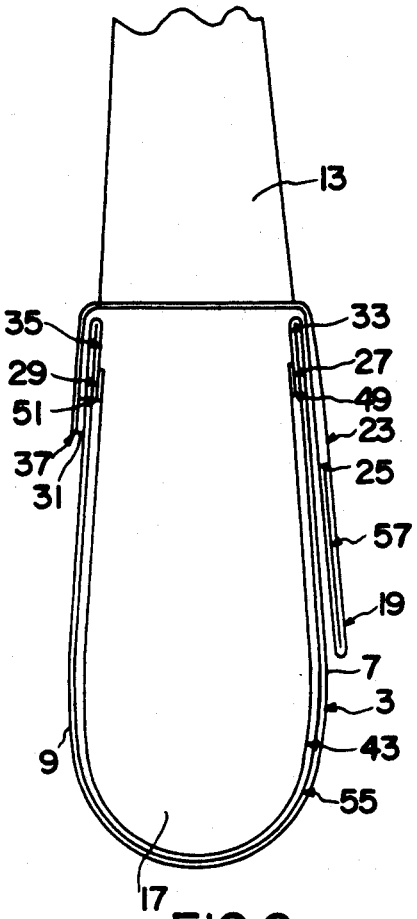
FIG. 8 is a sectional view of the handbag of FIG. 1 along the line 8—8 of FIG. 2.

Referring now to the drawings, and in particular to FIGS. 1–9, reference numeral 1 indicates one illustrative embodiment of shaped handbag of the present invention. The handbag 1 includes a fabric body 3 formed of a rectangular piece of material 5 turned to form generally parallel front wall 7 and back wall 9, self-fabric straps 11 and 13 which also form sides 15 and 17 of the purse body 3, and a removable flap 19 for closing an open mouth 21 of the purse.

The body 3, the straps 11 and 13, and the flap 19 may be sewn from a variety of fabrics, such as garment-weight fabrics or light-weight, non-structural leathers. These materials need not be, and preferably are not, self-supporting when sewn into the shapes of the present invention. Preferably, the fabrics are identical with, or complementary to, specific garments such as blouses, dresses, suits, or the like.

All of the fabric portions of the purse body 3 may be formed from one-and-a-quarter yards of forty-five inch fabric or from three-quarters of a yard of sixty inch fabric.

The rectangular piece 5 is cut twenty-five inches long by ten-and-a-half inches wide. The straps 11 and 13 are formed from four identical pieces of fabric, each cut thirty-three inches long. The lower end of each strap as cut is a five-and-a-half inch diameter semicircle, and the upper end is a two inch diameter semicircle. The flap 19 is formed of two pieces of material, an outer flap piece 23 and a facing 25. The outer flap piece 23 is cut twelve-and-a-quarter inches long by nine-and-five-eighths inches wide, with a semicircular end and a square end. The facing 25 is two inches shorter than the outer flap piece 23, but is otherwise the same, including the semicircular end.

All seam allowances in the purse body 3 are five-eighths inch. If heavy fabric is used, the seams should be reduced to one-half inch. All edged stitching is about one-sixteenth to one-eighth inch from the turned edge.

If light fabric is used, or if the straps are to be joined by buckling or buttoning as described hereinafter, iron-on interfacing is applied and fused to the wrong side of two of the four pieces making up the straps. An iron-on interfacing is likewise fused to the wrong side of the outer flap piece 23.

Seam allowances at each short end of the rectangular body piece 5 are turned under and stitched. Strips 27 and 29 of the loop half of a hook-and-loop pressure fastener (such as Velcro ®) are sewn to the right side of the fabric along the short ends of the of the piece 5, for attachment of a liner as described hereinafter. A similar strip 31 of loop-type fastener is sewn parallel to the strip 29, spaced two-and-a-half inches from the finished short edge of the piece 5, for attachment of the flap 19 as described hereinafter. Each short end of the body piece 5 is turned, right sides together, along a line one-and-a-half inches from the short edges, to form pockets 33 and 35 for a plastic piece as described hereinafter. The edges of the pockets along the long sides of the piece 5 are stitched along the seam lines and the facing is trimmed. The pockets 33 and 35 are then turned right side out and seam allowances along each long end of the rectangular body piece 5 are turned under and pressed without stitching.

Two strap sections, one interlined, are sewn right sides together, leaving a gap for turning. After trimming close to the seam, the strap is turned and pressed to form the finished strap 11. The strap 13 is formed in the same manner.

The strap 11 is joined to the rectangular body piece 5 by aligning the center of the strap 11 with the center of the wrong side of one long edge of the piece 5. Edges are aligned and edge stitched. At the short edge of the piece 5 (the top of the purse body 3), the stitching is reinforced. Then the loose side of the body is aligned and pinned to the strap. Stitching is continued around the strap 11 to the other side of the piece 5, where the stitching is again reinforced before it is continued to the center of the long edge of the piece 5. The strap 13 is attached in the same manner.

The square end of the outer flap piece 23 and the facing piece 25 are seamed. That end of the outer flap piece 23 is then turned under, right side to right side, along a line two inches from the end and pressed to form a self-facing. The facing 25 is placed on the outer flap piece 23 right side to right side, so that its seamed edge abuts the seamed edge of the self-facing of the outer flap piece 23. The pieces 23 and 25 are sewn along their seam lines, trimmed, turned right side out, and pressed to form the flap 19. The facing 25 forms a pocket for the insertion of a stiffening piece as described hereinafter. The flap 19 is edge stitched along its sides and rounded end. A strip 37 of hook type hook-and-loop fastener is sewn to the self-facing of the flap 19 for attachment to the loop type fastener strip 31.

In the same manner, second and third flaps 19A and 19B may be made of different, complementary materials, to permit the purse 1 to be used with different outfits, or to change its appearance for different occassions. The purse body may, for example, be formed of a neutral fabric, and the flaps may be interchanged to match the wearer's clothing. In these exemplary embodiments, the flap 19A has a pointed, rather than rounded, free end, and the flap 19B has a square free end.

The straps 11 and 13 may be connected to each other in various standard ways, such as tying, buckling, or other quick-connect fasteners such as snaps or hook-and-loop fasteners. In the illustrative embodiment, buttons 39 are sewn to the strap 11 and corresponding button holes 41 are formed in the strap 13 to provide an adjustable length strap.

The purse body as thus far described could be used as a purse only if the fabric from which it is made is of relatively heavy weight, such as denim. Even then, it would quickly lose its shape when used.

For the purpose of maintaining the shape and neat appearance of the purse body 3, a plastic insert 55 in the form of a rectangular sheet of resilient plastic material is bent into a U-shape, placed into the handbag body 3, and tucked into the pockets 33 and 35. Because the insert 55 is only tucked into place and not permanently attached to the handbag body 3, it is also removable. The plastic sheet and the flexible body "skin" 3 hold each other in a formed purse. The body 3 is formed to the shape of the bent sheet 55 and holds the sheet in its bent form. The sheet 55 holds the fabric taut, by acting as a stretcher for the body piece 5 and by resiliently stretching the sides 15 and 17.

The plastic sheet 55 is formed of a material which is sufficiently flexible and stiff to be bent into a U-shape for insertion into the purse body and to spring back to a generally flat shape when removed. Cardboard lacks these qualities and is not generally acceptable as the sheet 55. A particularly appropriate material is a high impact polystyrene having a thickness of from 0.025" to 0.040". A commercially available material is sold by Primex Plastic Corp. of Garfield, N.J., as Prime-Impax ®-450. This material is sufficiently rigid to resist deformation by objects normally carried in a purse or briefcase. It has sufficient spring to urge the mouth of the purse body 3 open regardless of how filled the purse is, and it does not lose this property by taking a set after prolonged usage. It does not crease, and it resists cracking under even heavy usage. The sheet 55 is cut to the same dimensions as the finished rectangular body part 5, less the edge stitching. In the preferred embodiment, the sheet 55 is 0.035" high impact polystyrene, twenty and three-eighths inches long by nine inches wide. The sheet may be trimmed with scissors, knife, or rolling cutter. The corners of the sheet 55 are preferably rounded by cutting or by filing with an emery board, to prevent them from catching as they are inserted into the pockets 33 and 35. The short edges of the sheet 55 must be bent as they are inserted into the pockets 33 and 35, and they readily spring flat.

A stiffener 57 for the flap 19 is also cut of the same material as the stiffener 55. The stiffener 57 is a semicircle eight and one-eighth inch in diameter, extended slightly to a height of four and one-half inches. The stiffener 57 is inserted into the bottom of the pocket formed by the facing 25. The stiffener 57 retains the shape of the flap 19 and gives the flap sufficient weight to keep the mouth of the purse covered.

Corresponding stiffeners 57A and 57B are cut for the flaps 19A and 19B.

The stiffeners 57 may be removed from the flaps 19 and inserted into other flaps 19 of the same size and shape, to permit still other flaps to be used with the same purse body 3.

An optional fabric liner/organizer 43 is shown in FIG. 7. The liner/organizer 43 may be made of any durable fabric, and is preferably of a neutral color so that it may be used with different purses. The liner/organizer 43 differs from the purse body 3 in size and shape only in being about a quarter inch smaller in length and width and about half an inch shorter than the purse body 3 and in lacking straps. The organizer 43 is sewn in the same manner as the purse body 3. Seam allowances along the top of a body piece 45 are turned down, as are the seam allowances of two side pieces 47. Hook-and-loop fasteners 49 and 51 are sewn at the top of the body piece 45. Organizer pieces 53 are sewn from two pieces of fabric, joined with stitching to form pockets and pencil slots, and sewn to the top inside of the organizer 43. One side piece 47 is sewn to each side of the organizer body 45 in the same manner as the sides 11 and 13 are sewn to the purse body piece 5. The organizer 43 is then slipped into the purse body 3. The hook type fasteners 49 and 51 are attached to the loop type fasteners 27 and 29 on the interior of the body 3, at the open mouth of the body 3, to releasably attach the liner-/organizer 43.

The liner/organizer 43 allows the user to remove the contents of the purse at one time, rather than piecemeal. The organizer 43 also helps to reinforce the purse body 3 and, when filled, tends to retain the shape of the purse. It also permits the contents of the purse to be moved easily from one purse 1 of the invention to another such purse of the same size.

The purse 1 may easily be disassembled for cleaning the purse body 3 or for storage of the purse body or stiffener 55. If the optional liner/organizer 43 is inserted in the purse body 3, it should be removed first. Otherwise, the contents of the purse are simply removed in the normal manner. The stiffener sheet 55 may be removed by lifting the center of the fabric forming the pocket 35, bending the sheet 55 to remove it, and removing the sheet from the purse body 3. The purse body 3 may then be cleaned and stored flat. The stiffener 55 may also be stored flat, or it may be transferred to another purse 1 of the same dimensions.

Although the first illustative embodiment of the present invention has many advantages, other embodiments of the invention are also possible. A few of these embodiments are described, together with their advantages and special features.

Figure 10:
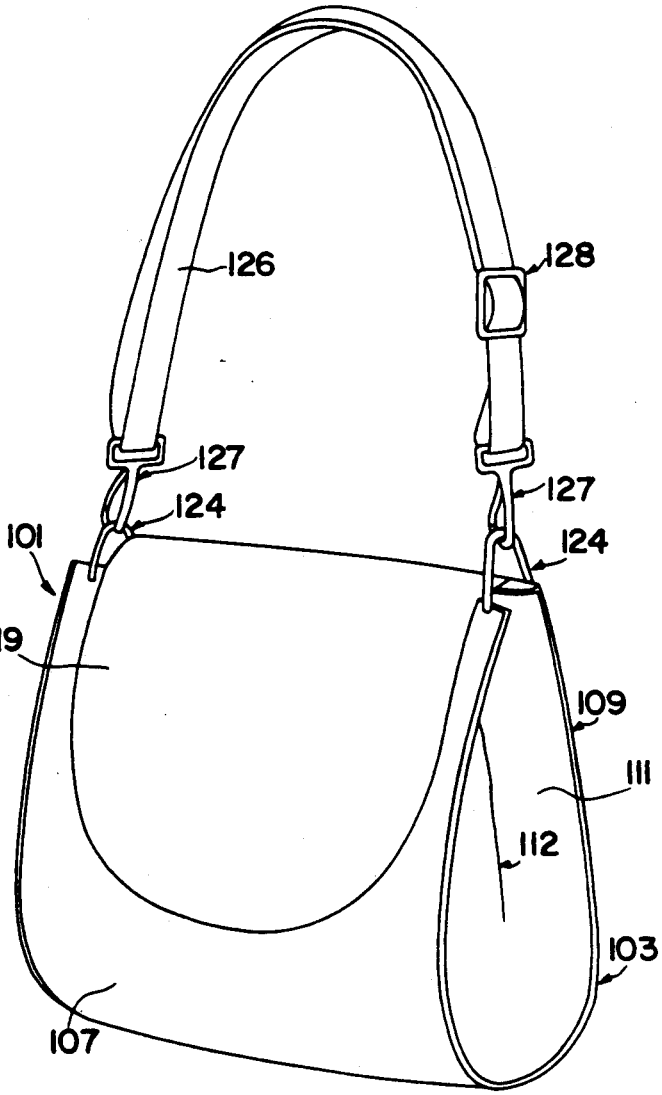
FIG. 10 is a view in perspective, corresponding to FIG. 1, showing a second embodiment of handbag in accordance with the present invention. This embodiment includes a detachable, interchangeable, adjustable strap.

For some fashion aspects, it is desirable to have the option to remove and interchange the handbag's straps. In the handbag 101 of FIG. 10, the side panels 111 are terminated even with the mouth of the handbag body 103. A tuck 112 is sewn into the side panel 111 to allow for the folding-in of the sides when the handbag is closed. The addition of two loops 124 sewn onto the ends of the front wall 107 and rear wall 109 adjacent the mouth of the body 103 allow for various straps 126 in a variety of colors and materials to be clipped to the loops 124 by clips 127. A buckle 128 makes the strap length adjustable. Because the flap 119 is detachable and interchangeable, a great deal of fashion flexibility is available to the wearer. The straps may be formed of material which complements the garment of the user, or it may be made of the same material as the garment. It will be seen that the flaps 119 may in fact be any of the flaps 19, 19A, or 19B of the first embodiment and may also be made of the same material as the user's garment.

Figure 11:
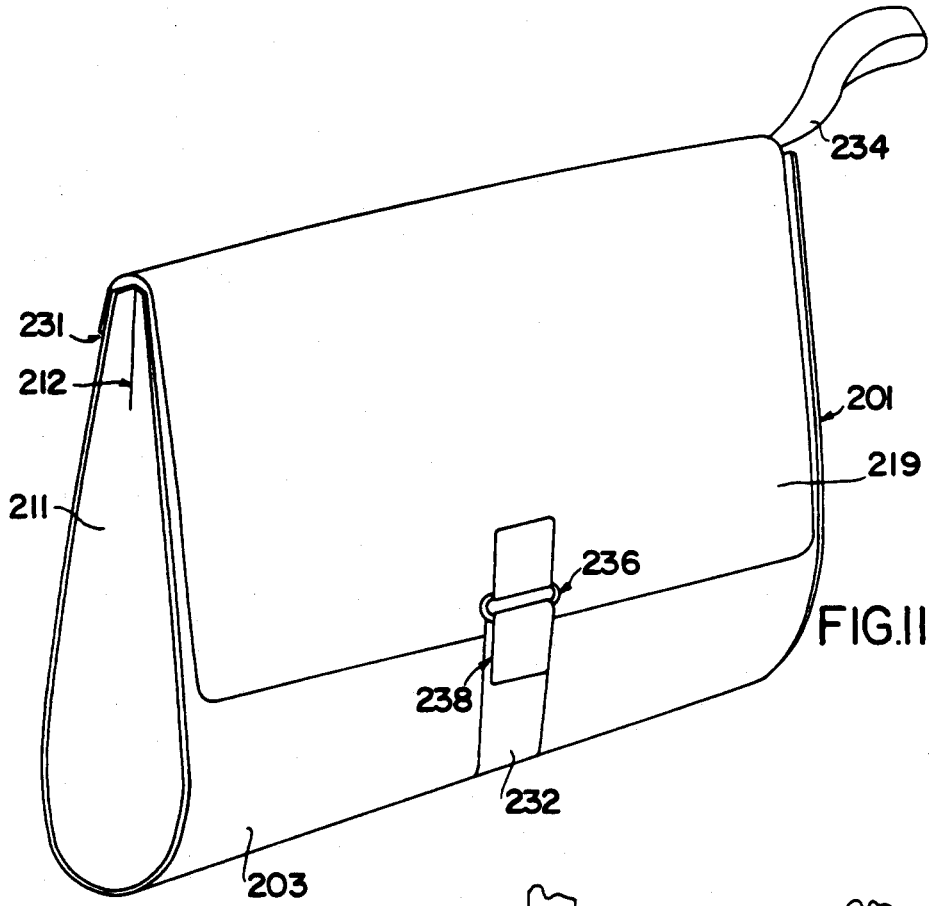
FIG. 11 is a view in perspective, corresponding to FIG. 1, showing a third embodiment of handbag in accordance with the present invention. This embodiment has no strap and is used as a clutch purse.

For other fashion aspects, it is desirable to eliminate the straps. A clutch purse 201 in accordance with such an embodiment of the present invention is shown in FIG. 11. Its body 203 is formed in much the same way as in the embodiment of FIG. 1, except for the dimensions and plastic insert thickness, which is determined by the diameter of the purse's rounded bottom. In this embodiment, the diameter is about two inches and the plastic insert is about 0.020" thick. In purse 201, the side panels 211 are terminated even with the mouth of the purse body 203, and a small tuck 212 is sewn into each panel 211. Velcro® strips are sewn at the center of each side of the mouth of the bag 201, to hold the mouth of the bag shut independent of a flap 219. To accommodate the stitching for this closure, the resilient plastic sheet is notched at the center of each end. The flap 219 is made detachable and interchangeable at a Velcro® attachment area 231. An optional wrap/strap closure 232 sewn to the upper end of the flap 219 allows the clutch to be carried by a loop 234 attached to the flap 219. The wrap/strap 232 loops behind and under body 203 and through a wire ring 236 on the flap 219, and attaches to itself with Velcro® 238 to form a secure closure.

Figure 12:
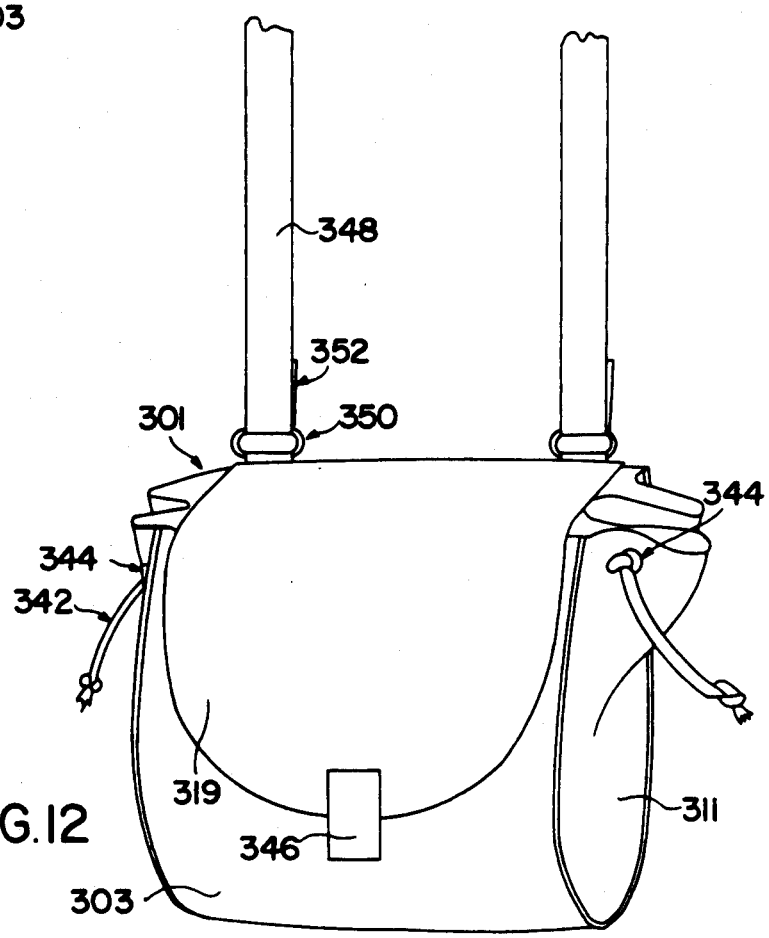
FIG. 12 is a view in perspective, corresponding to FIG. 1, showing a fourth embodiment of handbag in accordance with the present invention. This embodiment includes expandable, draw-string adjusted sides.

For other fashion aspects, it is desirable to expand the handbag's body. In the embodiment of handbag 301 of FIG. 12, side panels 311 are made wider at the top than in the handbag 1 of the first embodiment, and a draw string 342 runs through the top and is drawn closed with a knot 344 that can be positioned to suit the handbag's carrier. Alternatively, a slide may be substituted for the knot 344. In the embodiment of FIG. 12, the flap 319 (which is also detachable and interchangeable) contains a tab closure 346 that attaches to the handbag's body 303 for securing the flap. Because the tab closure is sewn through the flap 319, the plastic inserts for this embodiment of flap must include cutouts to accommodate the tab closure 346. The straps 348 of this embodiment are made detachable and interchangeable by looping through a wire ring 350 and attaching to itself with Velcro® 352.

In all of the foregoing embodiments, the handbag has been an open-topped purse closed by a removable flap. Other embodiments of the present invention are possible in which the handbag is closed by zippers extending up the sides and across the top of the handbag. These embodiments are well adapted not only to purses but to other handbags. Some of these embodiments are illustrated in FIGS. 13–16.

Figure 13:
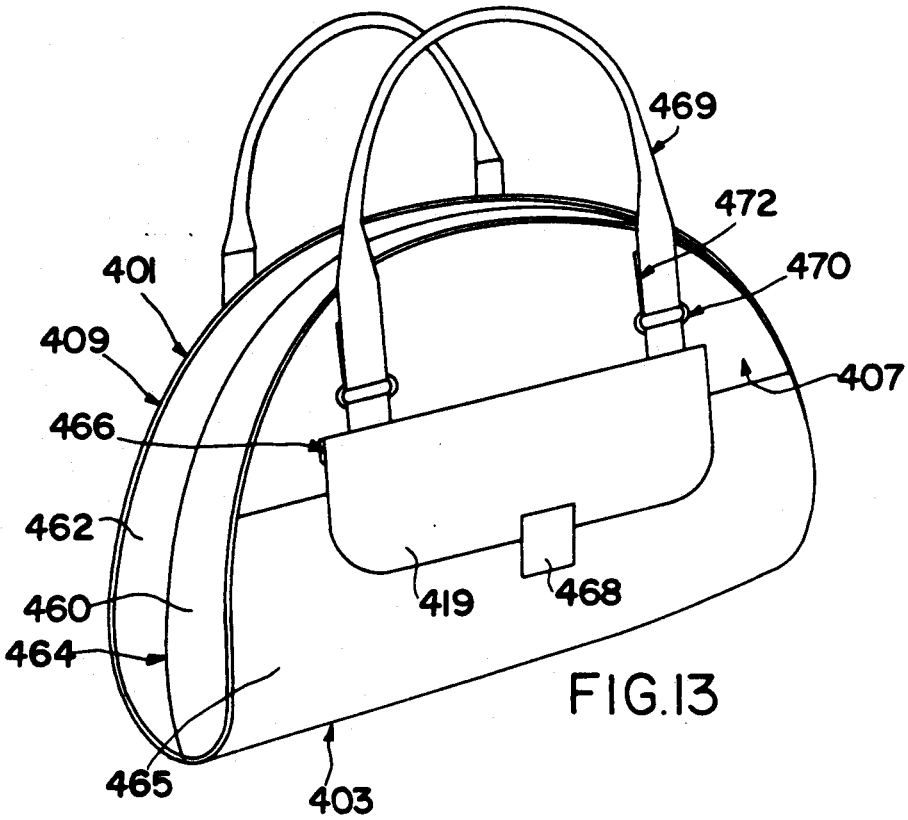
FIG. 13 is a view in perspective, corresponding to FIG. 1, showing a fifth embodiment of handbag in accordance with the present invention. This embodiment includes a zipper closure style.

In the embodiment of FIG. 13, a purse 401 is provided in which side panels 460 and 462 wrap around in two continuous pieces from side to side and are sewn onto the front wall 407 and rear wall 409 respectively of the handbag's body 403. A two-slide zipper 464 holds the two pieces 460 and 462 together. When unzipped, the handbag opens for access to the interior. If desired, the zipper may be completely unzipped to allow the handbag body 403 to lie flat. In this embodiment, the pockets which hold the resilient plastic sheet are semicircular facings, sewn around the semicircular upper periphery of the body 403. This embodiment also includes a liner/organizer, reshaped to accommodate its shape and connected to the semicircular facings by Velcro® along the bottom edge of the body's facings and along the top edge of the organizer. On the outside, pouch pockets 465 are sewn into the body 403. The upper edge of the pocket 465 is aligned with the lower edge of the facing pocket, so that the front wall 407 and rear wall 409 of the purse body 403 are a double thickness throughout. Above each pocket 465 an access flap 419 is attached to the body 403 with Velcro® 466 and is thus removable and interchangeable. This flap preferably is stiffened with a plastic insert in the manner of the flap 19 of the first embodiment and can be sewn from various fabrics. The flap 419 includes a tab closure 468 for access to the pouch pocket 465. The straps 469 of this embodiment are made detachable and interchangeable by looping through a wire ring 470 and attaching to itself with Velcro® 472. Handbag or shoulder bag length straps can be made and interchanged.

Figure 14:
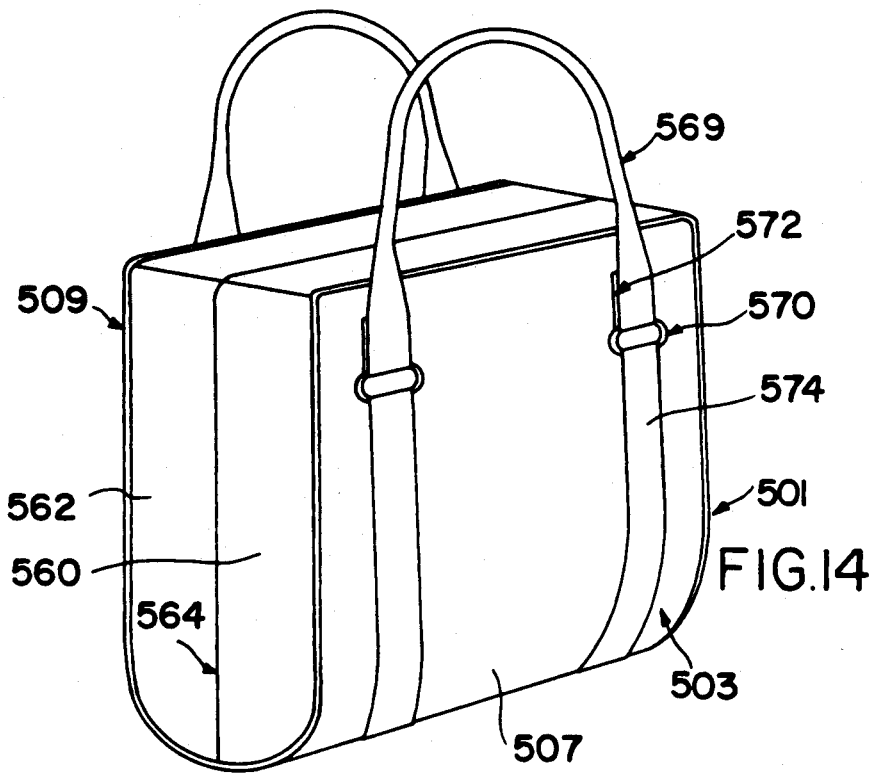
FIG. 14 is a view in perspective, corresponding to FIG. 1, showing a sixth embodiment of handbag in accordance with the present invention. This embodiment shows the use of the handbag as a lunch box.
Figure 15:
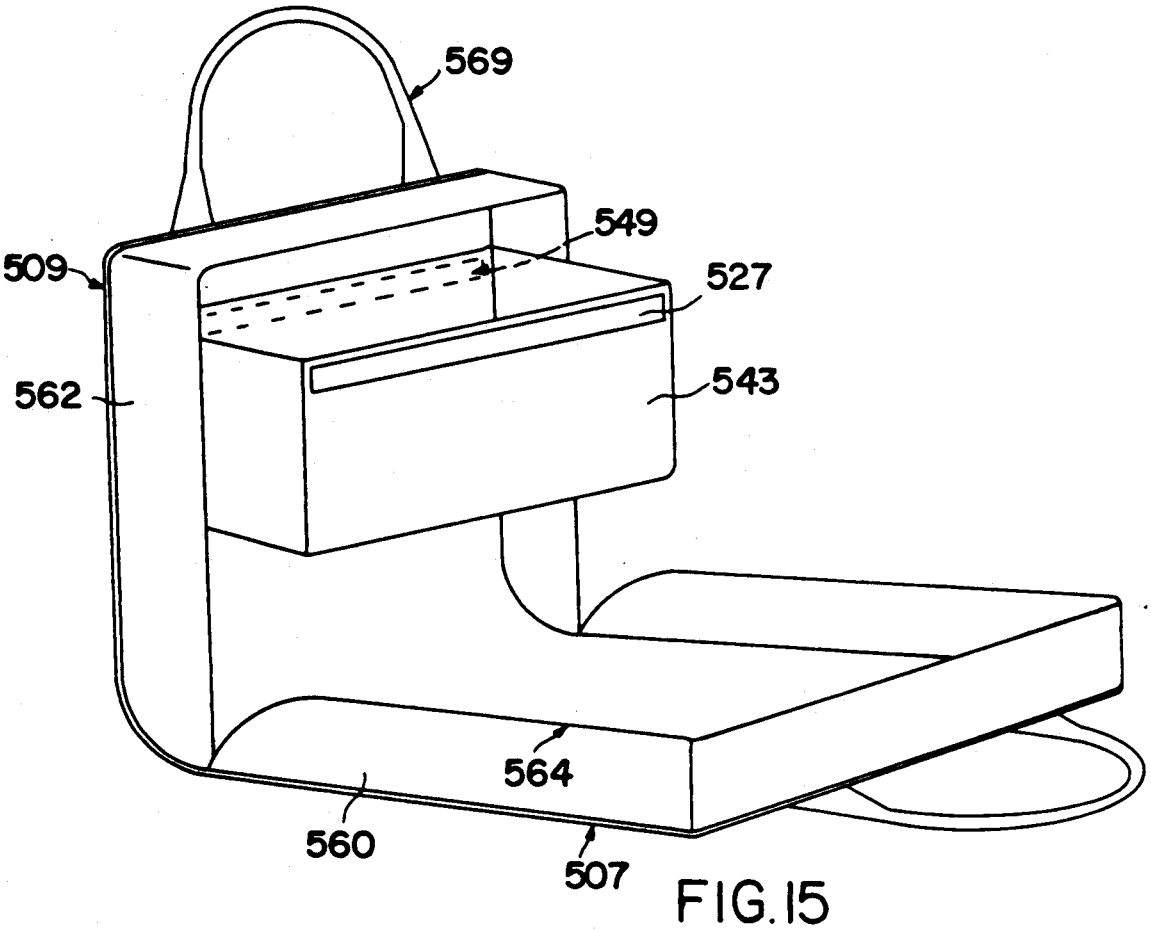
FIG. 15 is a view of the handbag of FIG. 14 in an open position, showing a food pouch liner and the space available for a vacuum bottle.

FIG. 14 shows the application of the invention to a handbag 501 which is not a purse but is used as a lunch box. In this embodiment, the side panels 560 and 562 wrap around in two continuous pieces from side to side and are sewn onto the front wall 507 and rear wall 509 respectively of the handbag's body 503. A zipper 564 holds the two pieces 560 and 562 together. When unzipped, the lunch box opens for access to the interior, as shown in FIG. 15. There is space at the rounded bottom for a vacuum bottle, not shown. A liner 543, fashioned from vinyl, hangs halfway down into the interior for holding sandwiches or other food. It is attached with Velcro® 549 and 527 at the mouth of the lunch box 501 and is removable. The straps 569 of this embodiment are similar to the straps 469 of the previous embodiment. They are made detachable and interchangeable by looping through a wire ring 570 and attaching to itself with Velcro® 572. A continuous strap 574 runs from wire ring 570 to wire ring 570 for added strength.

Figure 16:
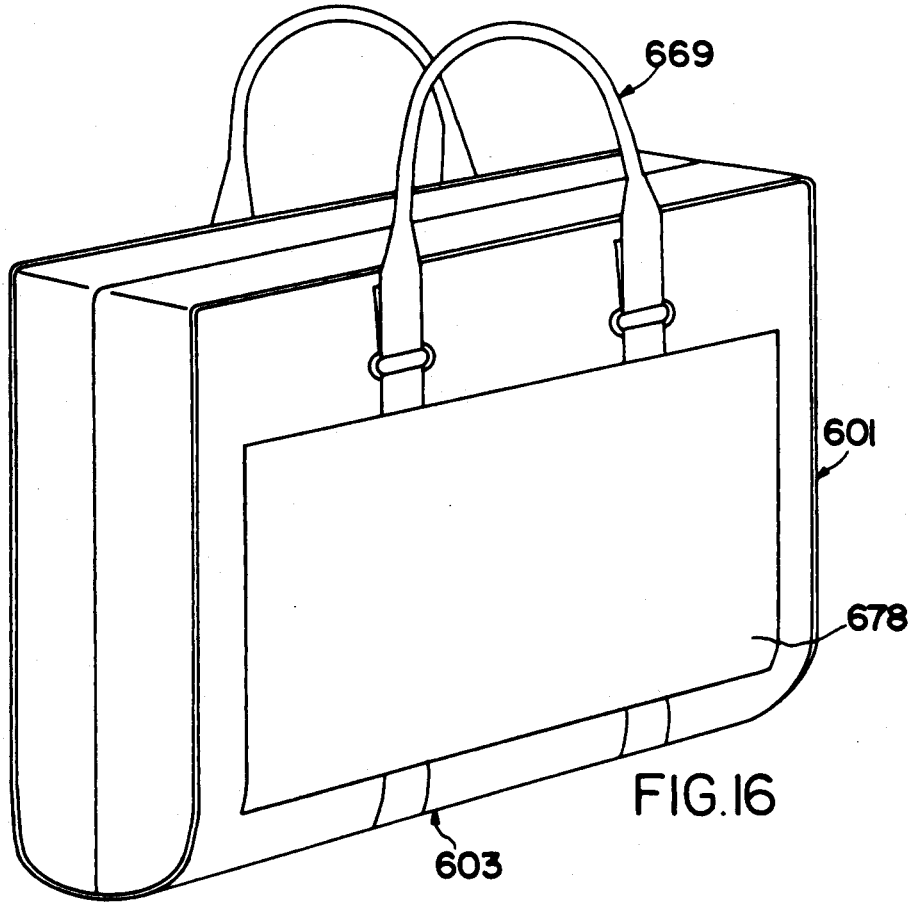
FIG. 16 is a view in perspective, corresponding to FIG. 1, showing a seventh embodiment of handbag in accordance with the present invention. This embodiment shows the use of the handbag as a brief case.

FIG. 16 shows the application of the invention to a brief case 601. The body 603 of the briefcase 601 may be identical with the body 503 of the lunch box 501 except in their dimensions and proportions, and straps 669 and their attachment method may be substantially the same as the straps 569 of the lunch box 501. The addition of exterior pockets 678 gives the brief case additional storage space. When unzipped, the brief case opens for access as in the lunch box 501, but it does not contain the one piece liner/organizer. Instead, it has a series of organizers that hang on the facings at the upper edge of the brief case and are removably attached with Velcro®.

Numerous variations within the scope of the appended claims will be apparent to those skilled in the art in light of the foregoing description and accompanying drawings. The materials, dimensions and relations of the parts may be varied, although the preferred embodiments provide a handbag of convenient size which may be personalized by the user by any or all of the accessory features. The handbag may be used for other purposes, such as a backpack, particularly a backpack which may be converted to a purse, by the use of removable and repositionable straps. The flap of the first embodiments may be sewn on rather than replaceable. Many of the features of the various embodiments may be incorporated in other embodiments, and parts of the embodiments may be omitted. These variations are merely illustrative.

I claim:

1. A handbag comprising a fabric body, the body having a bottom, sides and an openable mouth, and a liner in the body, the liner being formed to fit snugly against at least two sides of the body, first quick-connect means on the inside of the at least two sides of the body and second quick-connect means on the liner for cooperating with the first quick connect means for releasably holding the liner, a third quick-connect means on the outside of at least one of said two sides of the body, flap means for covering the mouth of the body, and fourth quick-connect means for cooperating with the third quick connect means for releasably holding the flap means to the body, the handbag further including a flexible, resilient sheet shaped to pull the body taut to define a shaped handbag, the body of the handbag comprising pockets on the inside of the two sides of the body adjacent the mouth, the pockets holding the ends of the resilient sheet, the first quick-connect means being provided on the pockets.

2. The handbag of claim 1 wherein the liner is in the form of a bag shaped to fill the handbag body.

3. The handbag of claim 1 wherein the first quick-connect means are positioned adjacent the mouth of the body.

4. The handbag of claim 1 wherein the quick-connect means all comprise hook-and-loop type material.

5. The handbag of claim 1 wherein the flap comprises a pocket having an opening adjacent the fourth quick-connect means and a closed end remote from the fourth quick-connect means, and further comprises an insert in the pocket, the insert being made of a material stiffer than the flap, the insert filling the end of the flap remote from the fourth quick-connect means and drawing the material of the flap taut in at least one dimension.

6. A handbag comprising:

a soft, flexible, fabric body having insufficient strength to retain a shape, the body including
- i. a front wall;
- ii. a rear wall; and
- iii. side walls connecting the front wall and rear wall to form a flexible container; and b. a stiff, resilient sheet, the sheet being conformable to a curved cylindrical shape determined by the fabric body, the sheet being bent into a U-shape and being removably inserted into the handbag body, the resilient sheet giving the handbag body shape and continuously resiliently urging the front wall and rear wall apart.

7. The handbag of claim 6 wherein the resilient sheet is made of plastic material, wherein the plastic material bends readily to a U-shape, and wherein the resilient material returns to a generally flat configuration when released.

8. The handbag of claim 6 wherein the front wall and the rear walla re formed from a strip of material, the resilient sheet conforming to the strip when bent into the U-shape and inserted into the handbag body.

9. The handbag of claim 8 further including pockets at opposite ends of the strip of material adjacent two parallel opposed mouth edges of the handbag, the pockets holding the ends of the resilient sheet, the pockets and the resilient sheet being proportioned to pull the strip taut in two dimensions across the outer surface of the sheet.

10. The handbag of claim 9 wherein the sides of the handbag hold the handbag from opening beyond a desired shape and provide a generally rectangular mouth at the top of the handbag body.

11. The handbag of claim 10 wherein the sides of the handbag body extend above the mouth of the handbag and act as carrying straps.

12. The handbag of claim 10 further comprising a flap for closing the mouth of the body.

13. The handbag of claim 12 further including quick-connect means at one end of the flap for connecting the flap to the body, a pocket at an end of the flap remote from the quick-connect means, and an insert in the pocket, the insert being made of a material stiffer than the flap.

14. The handbag of claim 12 further including quick-connect means at one end of the flap for connecting the flap to the body, a strap attached to the flap adjacent the quick-connect means, and a fastener attached to the flap for cooperation with the strap, whereby when the flap is attached to the body the strap may be passed around the body and secured at both ends to the flap.

15. The handbag of claim 10 wherein sides of the handbag body include draw strings for adjusting the size of the open mouth.

16. The handbag of claim 8 further including a liner-/organizer in the form of a bag shaped to fill the handbag body and quick connect means for attaching the liner/organizer to the body.

17. The handbag of claim 8 wherein the sides of the handbag body are continuous across the top of the handbag body and include zippers for access to the interior of the handbag body.

18. The handbag of claim 17 wherein the zippers permit the body to open flat without removing the resilient sheet from the body.

19. The handbag of claim 17 wherein the handbag is a lunch box, wherein the U-shaped bottom of the handbag houses a vacuum bottle, and wherein the handbag further includes a flexible, moisture-proof liner/organizer releasably secured to at least one wall of the handbag.

20. A handbag comprising a soft, sewn, fabric body, the body having a bottom, a front wall, a rear wall, two side walls, an openable mouth, and downwardly opening pockets on the inside of the front and rear walls adjacent the mouth, and first quick-connect means on the outer surface of each pocket, a stiff insert in the fabric body, the insert extending into the pockets and giving shape to the fabric body, and a liner within the body and insert, the liner comprising second quick-connect means on the liner for cooperating with the first quick connect means on the pockets for releasably holding the liner.

21. The handbag of claim 20 wherein the quick-connect means all comprise hook-and-loop type material.

* * * * *